US008490278B2

(12) United States Patent
Komai et al.

(10) Patent No.: US 8,490,278 B2
(45) Date of Patent: Jul. 23, 2013

(54) METHOD FOR PRODUCTION OF MAGNESIUM ALLOY MOLDING-PROCESSED ARTICLE, AND MAGNESIUM ALLOY MOLDING-PROCESSED ARTICLE

(75) Inventors: Masao Komai, Yamaguchi (JP); Koh Yoshioka, Yamaguchi (JP)

(73) Assignee: Toyo Kohan Co., Ltd., Chiyoda-Ku, Tokyo (JP)

( * ) Notice: Subject to any disclaimer, the term of this patent is extended or adjusted under 35 U.S.C. 154(b) by 678 days.

(21) Appl. No.: 12/064,791

(22) PCT Filed: Aug. 25, 2006

(86) PCT No.: PCT/JP2006/316777

§ 371 (c)(1),
(2), (4) Date: Sep. 2, 2009

(87) PCT Pub. No.: WO2007/023967

PCT Pub. Date: Mar. 1, 2007

(65) Prior Publication Data

US 2010/0061881 A1 Mar. 11, 2010

(30) Foreign Application Priority Data

Aug. 25, 2005 (JP) ..... 2005-244579
Oct. 12, 2005 (JP) ..... 2005-297395

(51) Int. Cl.
*B21B 1/46* (2006.01)

(52) U.S. Cl.
USPC ..... 29/527.4

(58) Field of Classification Search
USPC ..... 29/527.4, 527.3, 527.2, 418; 420/429, 420/409; 72/46; 428/35.7, 425.9, 418, 458, 428/436, 447, 433
See application file for complete search history.

(56) References Cited

U.S. PATENT DOCUMENTS

| | | | | |
|---|---|---|---|---|
| 6,009,913 | A | 1/2000 | Kojima et al. | |
| 2010/0143626 | A1 * | 6/2010 | Komai et al. | 428/35.7 |

FOREIGN PATENT DOCUMENTS

| | | | |
|---|---|---|---|
| CA | 2525068 | A1 | 11/2000 |
| JP | 06-099225 | A1 | 4/1994 |
| JP | 10-137863 | A1 | 5/1998 |
| JP | 2004-197132 | A1 | 7/2004 |
| JP | 2004-338218 | A1 | 12/2004 |

* cited by examiner

*Primary Examiner* — John C Hong
(74) *Attorney, Agent, or Firm* — Browdy and Neimark, pllc

(57) ABSTRACT

Disclosed is a method for producing a magnesium alloy press-formed body at a high degree of forming and at a low cost. Also disclosed is a magnesium alloy press-formed body having an aesthetic surface, which is produced by the method. The method comprises the steps of applying an organic resin capable of imparting formability (e.g. a water-soluble urethane resin, a water-soluble polyester resin, a water-soluble acrylic resin, a water-soluble epoxy resin, or an organic resin produced by modification of any one of these resins), or an organic resin which is prepared by mixing any one of these resins with a silane coupling agent, colloidal silica, a lubricant, a metal alkoxide or the like by coating onto the surface of a magnesium alloy material, press-forming the organic resin-coated magnesium alloy material into a desired shape, and removing the organic resin using a resin removing liquid.

4 Claims, No Drawings

METHOD FOR PRODUCTION OF MAGNESIUM ALLOY MOLDING-PROCESSED ARTICLE, AND MAGNESIUM ALLOY MOLDING-PROCESSED ARTICLE

TECHNICAL FIELD

The present invention particularly relates to a manufacturing method of a magnesium alloy press-formed body having a beautiful surface after press-forming and a magnesium alloy press-formed body manufactured by using the manufacturing method.

BACKGROUND ART

Attempts have been made to use a light-weighted magnesium alloy as a material for manufacturing members of an exterior casing of a miniaturized portable electronic equipment such as a mobile communication equipment or a notebook-type personal computer, a material for manufacturing members of a large-sized casing such as a traveling suitcase or a document accommodating attaché case, a material for manufacturing automobile-use members such as a hood, a trunk lid, doors or fenders and the like. However, magnesium alloy exhibits poor formability and hence, it is extremely difficult to perform press-forming with a high degree of forming. As a method for forming such hard-to-form magnesium alloy by drawing, there have been proposed several methods which heat magnesium alloy to a recrystallization temperature region at the time of press-forming including a method which performs press-forming by drawing after heating a die, a punch, and a wrinkle pressing member of a drawing forming device to an approximately 150 to 400° C. (see patent document 1, for example), and a magnesium-alloy-made hard-case manufacturing method which heats a die, a punch and a blank holder, and heats magnesium to a recrystallization temperature region by way of these press-forming tools, and forms a magnesium blank into a box shape by hot deep drawing while inducing an annealing effect in which magnesium is easily recrystallized, softened and deformed by heating (see patent document 2, for example).

Further, there has been also proposed a method which uses a lubricant for facilitating forming. For example, there have been proposed a method which forms a super-hard thin layer such as titanium nitride or diamond-like carbon on a surface of a press mold by coating (see patent document 3, for example), and a method which performs press-forming using a plastic forming oil for magnesium alloy or aluminum alloy containing biodegradable oil and fat, a rust-proofing lubricant, an extreme-pressure additive, an organic zinc compound, and an organic molybdenum based compound (see patent document 4, for example). However, even when magnesium alloy is press-formed by heating magnesium alloy, by using the lubricant, or by heating magnesium alloy while using the lubricant, abrasions are liable to be formed on a surface of magnesium alloy which comes into contact with a tool at the time of forming. Accordingly, magnesium alloy cannot be used in applications where aesthetic surface appearance is required.

To prevent the formation of abrasions on the surface of magnesium alloy at the time of press-forming, there have been proposed a method which performs plastic forming by mounting a plate made of pure magnesium, pure aluminum or a resin softer than a magnesium alloy material on a surface of at least one of a punch and a die (see patent document 5, for example), and a method which performs press forming of magnesium alloy at a high temperature by mounting a fluororesin film sheet on upper and lower surfaces of a heated magnesium thin plate as a heat insulation material (see patent document 6, for example). However, in these methods, the soft plate made of pure magnesium, pure aluminum or a resin or the fluororesin film sheet used as the heat insulation material must be exchanged in use for every forming and hence, these methods are not favorable for the continuous production. Further, since the fluororesin film sheet is particularly expensive, a press-formed body obtained by these methods inevitably becomes disadvantageous in terms of cost.

As prior art literatures relevant to the present invention, the following are named.

Patent Document 1: JP-A-2003-290843
Patent Document 2: JP-A-2002-254115
Patent Document 3: JP-A-2003-154418
Patent Document 4: JP-A-2003-105364
Patent Document 5: JP-A-2001-300643
Patent Document 6: JP-A-6-328155

DISCLOSURE OF THE INVENTION

Problems that the Invention is to Solve

It is an object of the present invention to provide a manufacturing method of press-forming a magnesium alloy press-formed body with high formability at a low cost, and a magnesium alloy press-formed body having a beautiful surface which is obtained by performing press-forming using the manufacturing method.

Means for Solving the Problems

To achieve the above-mentioned object, the manufacturing method of a magnesium alloy press-formed body of the present invention is characterized by including the steps of: applying an organic resin capable of imparting formability to a surface of a magnesium alloy material by coating; press-forming the organic resin-coated magnesium alloy material into a desired shape, and removing the organic resin from the organic resin-coated magnesium alloy material using a resin coating removing liquid (claim 1).

In the manufacturing method of a magnesium alloy press-formed body (claim 1), surface treatment and/or coating is applied to the magnesium alloy material press-formed in the desired shape after removing the organic resin (claim 2).

In the manufacturing method of a magnesium alloy press-formed body (claim 1 or 2), as the organic resin, an organic resin which is constituted of one, two or more selected from a group consisting of a water-soluble urethane resin, a water-soluble polyester resin, a water-soluble acrylic resin, a water-soluble epoxy resin, and a resin produced by modification of any one the organic resins is used (claim 3).

In the manufacturing method of a magnesium alloy press-formed body (claim 3), as the organic resin, an organic resin containing one, two or more selected from a group consisting of a silane coupling agent, colloidal silica, a lubricant, and a metal alkoxide is further used (claim 4).

In the manufacturing method of a magnesium alloy press-formed body (claim 4), as the organic resin, an organic resin containing a heat-resistance imparting agent is further used (claim 5).

In the manufacturing method of a magnesium alloy press-formed body (claims 1 to 5), a liquid mainly constituted of alkaline aqueous solution having pH of 10 or more is used as the resin coating removing liquid (claim 6).

Further, the magnesium alloy press-formed body of the present invention is a magnesium alloy press-formed body manufactured by using any one of the above-mentioned manufacturing methods of the magnesium alloy press-formed body (claims 1 to 5) (claim 7).

Best Mode for Carrying Out the Invention

Hereinafter, the present invention is explained in detail.

As a magnesium alloy material used in the manufacture of the magnesium alloy press-formed body of the present invention, it is preferable to use pure magnesium or a magnesium alloy containing 1.0 to 9.0% by weight of aluminum, 0.5 to 6.0% by weight of zinc, 0.05 to 2.0% by weight of manganese and magnesium and unavoidable impurities as a balance, and having a crystalline particle size of 2 to 50 μm, more preferably 2 to 10 μm (hereinafter, for the sake of brevity, both of pure magnesium and magnesium alloy being referred to as magnesium alloy). A sheet material of Magnesium alloy made by extruding, cutting or hot-rolling is applicable to the following press-forming. In using magnesium alloy as the sheet material, a thickness of the sheet material may preferably be set to 0.05 to 2.0 mm. A press-forming magnesium alloy material is produced by applying an organic resin to a surface of the magnesium alloy material.

As the organic resin applied to the surface of the magnesium alloy material, it is preferable to use a water-soluble or water-dispersing resin. That is, a water-soluble urethane resin, a water-soluble polyester resin, a water-soluble acrylic resin, and a water-soluble epoxy resin may preferably be used. An acrylic modified polyester resin and a phenyl silicon modified acrylic resin which are formed by modifying the above-mentioned resins may also preferably be used. These resins may be used in a single form or in mixture consisting of two or more kinds of resins. An addition quantity of the organic resin may preferably be set to a value which falls within a range from 20 to 85% by weight. When the addition quantity of the organic resin is less than 20% by weight, a formed organic resin film is liable to be damaged by press-forming and hence, the addition quantity of less than 20% by weight is not desirable. When the addition quantity of organic resin exceeds 85% by weight, although there arises no problem with respect to properties thereof, the addition quantity exceeding 85% is not economical. Further, a temperature exceeding 150° C. is often used preferably as a forming temperature of magnesium alloy material and hence, it is preferable to use an organic resin possessing the excellent heat resistance.

Although the organic resin film may be formed by applying the water-soluble or water-dispersing resin by coating to the above-mentioned magnesium alloy material in a single form and by drying the applied resin, to enhance the press-forming formability and the corrosion resistance, the organic resin may contain the following materials. In adding other materials, it is desirable that the organic resin contains 20% or more by weight of water-soluble or water-dispersing resin. When an addition quantity of water-soluble or water-dispersing resin is less than 20% by weight, the formed organic resin film is liable to be damaged by forming and hence, the addition quantity of less than 20% by weight is not desirable. With the addition of a silane coupling agent, the adhesiveness of the organic resin film to the magnesium material, more particularly, the adhesiveness of the organic resin film to the magnesium material at the time of press-forming can be remarkably improved. The silane coupling agent is classified, based on kinds of functional groups, into a vinyl-based silane coupling agent, an epoxy-based silane coupling agent, a styryl-based silane coupling agent, a methacryloxy-based silane coupling agent, an acryloxy-based silane coupling agent, an amino-based silane coupling agent, an ureide-based silane coupling agent, a chloropropyl-based silane coupling agent, a mercapto-based silane coupling agent, an isocyanate-based silane coupling agent and the like. These coupling agents can be effectively used in the manufacturing method of a magnesium alloy press-formed body of the present invention. This is because that these silane coupling agents exhibit the excellent bonding property, that is, the excellent adhesiveness with respect to almost all resins. To be more specific, the epoxy-based silane coupling agent KBMM403 exhibits excellent bonding with the urethane-based resin, the epoxy-based resin or the like, and the amino-based silane coupling agent KBM903 exhibits excellent bonding with the acrylic resin or the like and hence, these silane coupling agents exhibit excellent adhesiveness with these resins. Further, various kinds of urethane-based resins are present besides the epoxy silane coupling agent KBM403 and hence, the amino-based silane coupling agent KBM903 also can acquire an excellent effects. The organic resin film may preferably contain not more than 5% by weight of silane coupling agent, and may more preferably contain no more than 1% by weight of silane coupling agent. Even when an addition quantity of the silane coupling agent exceeds 5% by weight, the enhancement of adhesiveness is saturated and hence, such excessive addition of the silane coupling agent becomes economically disadvantageous.

Further, the organic resin film increases hardness by containing colloidal silica therein thus enhancing abrasion resistance and also corrosion resistance. The organic resin film may preferably contain not more than 50% by weight of colloidal silica. When an addition quantity of colloidal silica exceeds 50% by weight, the organic resin film becomes excessively hard and hence, the formability of the organic resin film is deteriorated whereby cracks are liable to be easily occur in the organic resin film at the time of press-forming.

Further, with the addition of the lubricant in the organic resin, formability of the press-forming magnesium alloy material formed by applying the organic resin film to the magnesium alloy material is enhanced. As the lubricant, a higher fatty acid such as a lauric acid, a myristic acid, a palmitic acid or a stearic acid, a calcium salt, an aluminum salt, a zinc salt, a barium salt or a magnesium salt of these higher fatty acid, ester of a higher fatty acid such as a lauric acid, a myristic acid, a palmitic acid or a stearic acid, polyolefine wax such as polyethylene wax or polypropylene wax, fluorine-based wax such as polytetrafluoroethylene, polychlorotrifluoroethylene, poly fluorine vinylidene or poly fluorine vinyl, mineral powder such as graphite, molybdenum disulfide or boron nitride can be used. The organic resin film may preferably contain not more than 20% by weight of lubricant. When an addition quantity of the lubricant exceeds 20% by weight, the adhesiveness of the organic resin film to the magnesium alloy material at the time of press-forming is deteriorated.

Further, with the addition of metal alkoxide in the organic resin, the heat resistance of press-forming magnesium alloy material formed by applying the organic resin film to the magnesium alloy material can be enhanced. As metal alkoxide, alkoxide of boron, aluminum, titanium, vanadium, manganese, iron, cobalt, copper, yttrium, zirconium, niobium, lantern, cerium, tantalum or tungsten can be named. Among these metal alkoxides, titanium-based alkoxide can preferably be used. The organic resin film may preferably contain not more than 10% by weight of metal alkoxide therein. When an addition quantity of metal alkoxide exceeds 10% by weight, formability of press-forming magnesium alloy material formed by applying the organic resin film to the magnesium alloy material is lowered. Although the organic resin film may contain one kind of material selected from the above-mentioned silane coupling agent, the colloidal silica, the lubricant and the metal alkoxide in a single form, the organic resin film may contain two or more kinds of these materials.

By applying the organic resin acquired by the above-mentioned manner to the surface of the magnesium alloy material and by drying the organic resin, the organic resin film is formed. A thickness of the organic resin film may preferably be 0.1 to 50 μm, and more preferably be 1 to 10 μm with respect to the thickness after drying. Although the press-forming magnesium alloy material is acquired in this manner, a friction coefficient of a surface of the press-forming magnesium alloy material at a forming temperature may preferably be set to 0.2 or less. The friction coefficient at a forming temperature is a value of a friction coefficient at a temperature at which the press-forming magnesium alloy material is formed and is measured using a contact-type friction coefficient measuring device made by SHINTO Scientific Co., ltd. (HEIDON) (Dynamic Strain Amplifier 3K-34D, Peeling/Slipping/Scratching TESTER HEIDON-14).

The press-forming magnesium alloy material obtained by the above-mentioned steps exhibits the friction coefficient at a forming temperature of 0.2 or less and hence, the press-forming magnesium alloy material exhibits excellent formability. Accordingly, the press-forming magnesium alloy material can be preferably formed without using lubricating oil or a solid lubricant such as molybdenum disulfide which have been usually used in applications such as drawing, forging, rolling and press forging. Further, press-forming magnesium alloy material can be preferably formed also using the lubricating oil or the solid lubricant such as molybdenum disulfide which have been usually used and hence, the press-forming magnesium alloy material can be continuously formed in conventional manufacturing steps which include an oil coating step by using the conventional manufacturing method of magnesium alloy material which requires coating of lubricating oil and the manufacturing method of the present invention which requires no oil coating in combination. Further, by forming the press-forming magnesium alloy material by heating the press-forming magnesium alloy material within a temperature range not more than 350° C., more preferably within a hot forming temperature range of 200 to 350° C., the formability is further enhanced compared to the press-forming performed within a temperature range of less than 200° C. and hence, the press-forming magnesium alloy material can be press-formed at high formability. However, when the press-forming is performed within the temperature range exceeding 200° C., the organic resin film is decomposed or discolored, or cracks occur in the organic resin film thus deteriorating appearance and, at the same time, making the enhancement of formability difficult. Accordingly, in addition to the enhancement of heat resistance using the organic resin alone, by allowing the organic resin film to further contain a heat resistance imparting agent, it is possible to perform press-forming of the press-forming magnesium alloy material in a stable manner without discoloring the organic resin film or generating cracks in the organic resin film at a hot forming temperature range of high temperature from 200 to 350° C. or less whereby the formability can be also enhanced. As a result, in the press-forming of the press-forming magnesium alloy material, the forming temperature which enables the acquisition of formability equal to the formability obtained by the conventionally exercised press-forming which uses the lubricating oil can be further lowered within the temperature range of not more than 350° C. and hence, it is possible to acquire an advantageous effect that the excessive heat treatment becomes unnecessary. It is needless to say that coating of the lubricating oil at the time of press-forming becomes unnecessary.

As the heat-resistance imparting agent, heat-resistant resin such as polyimide or siloxane compound may preferably be used. As a siloxane compound, a polymer or a monomer of organosiloxane such as dimethylsiloxane, diethyl siloxane, methylethyl siloxane, diphenyl siloxane, methylphenylsiloxane, or polymer or monomer of organosiloxane which contains at least one group or two or more substituent groups consisting of one kind, two or more kinds of polyalkylene oxide group, hydroxyl group, amide group, carboxyl group, sulfone group and amino group may preferably be used. The organic resin film may preferably contain 5 to 80% by weight of heat-resistance imparting agents, and more preferably 10 to 60% by weight of heat-resistance imparting agent. By adding the heat-resistance imparting agent to the organic resin film in this manner, it is possible to perform press-forming with high formability by heating the press-forming magnesium alloy material up to the hot forming temperature range from 200 to 350° C. Here, although the organic resin may contain the heat-resistance imparting agent in a single form, the organic resin may contain the heat-resistance imparting agent in combination with one kind or two kinds or more of the above-mentioned silane coupling agent, the colloidal silica and the lubricant.

To a surface of the magnesium alloy press-formed body which is obtained by the above-mentioned press-forming, the organic resin film is adhered as a remaining material. The magnesium alloy press-formed body may be used in such a state as it is depending on applications. Further, when necessary, further coating maybe applied to the organic resin film. However, when the magnesium alloy press-formed body is used in applications where an aesthetic metal surface is required, it is necessary to remove the organic resin adhered to the surface of the magnesium alloy press-formed body as the remaining material. Although the organic resin may be removed by blowing off abrasive particles to a surface of the magnesium alloy press-formed body using a shot blast method, a surface shape is changed. Accordingly, it is preferable to remove the organic resin using removing liquid. As the removing liquid, it is preferable to use a liquid which contains alkali aqueous solution having pH of 10 or more as a main constituent and to which a surfactant imparting wettability and moisture or the like is added. When pH of the removing liquid is 10 or less, the removal of the organic resin film requires a long time. The alkali aqueous solution is inexpensive, the alkali aqueous solution which remains and is adhered to the surface of the magnesium alloy press-formed body after removing the organic resin can be easily removed with water and, thereafter, the surface of the magnesium alloy press-formed body can be dried. Accordingly, a cost required for the step of removing the organic resin can be made small.

Although the magnesium alloy press-formed body of the present invention can be obtained by the above-mentioned method, for imparting corrosion resistance and aesthetic appearance to the magnesium alloy press-formed body, known surface treatment such as anodizing, chemical conversion treatment or plating may be further applied to the press-formed body, or transparent or colored coating may be applied to the press-formed body. Further, after applying any one of these surface treatment to the magnesium alloy press-formed body, transparent or colored coating may be applied to the surface-treated press-formed body.

The magnesium alloy press-formed body manufactured using the above-mentioned manufacturing method of the present invention exhibits the beautiful metal surface and hence, the magnesium alloy press-formed body is preferably applicable to a material for members of an exterior casing of a miniaturized portable electronic equipment such as a mobile communication equipment or a notebook-type personal computer, a material for members of a large-sized casing such as a traveling suitcase or a document accommodating attaché case, a material for automobile-use members such as a hood, a trunk lid, doors or fenders and the like.

Embodiment

Hereinafter, the present invention is explained in detail in conjunction with an embodiment.

(Preparation of Press-Forming Magnesium Alloy Material)

As the press-forming magnesium alloy material, a sample press-forming magnesium alloy material is prepared in the following manner. That is, to both surfaces of a magnesium alloy sheet containing following alloy contents and having a sheet thickness of 0.4 mm, a resin solution shown in Table 1 or a resin solution which is prepared by adding a silane coupling agent, colloidal silica, a lubricant, a metal alkoxide or a heat resistance imparting agent to the resin shown in Table 1 is applied using a bar coater and is dried such that respective additives exhibit contents shown in Table 1 in a post-drying state and a thickness of the resin film after drying assumes a value shown in Table 1.

<Alloy Contents>

Al: 3.1% by weight, Zn: 1.1% by weight, Mn: 0.31% by weight, balance: Mg and unavoidable impurity elements <Average Crystalline Particle Size>

82 μm (Preparation of Magnesium Alloy Press-Formed Body)

By applying drawing to the press-forming magnesium alloy material obtained in the above-mentioned manner under following conditions, the magnesium alloy press-formed body is obtained. With respect to the forming temperatures, a dice and a blank holder have the same temperature and only the temperature of a punch is set to a room temperature. Further, a friction coefficient at a forming temperature is measured using a friction coefficient measuring device made by SHINTO Scientific Co., ltd. (HEIDON) to which a holder heater is attached. In measuring the friction coefficient, the press-forming magnesium alloy material fixed to the holder is heated at a forming temperature and, thereafter, the friction coefficient is measured under conditions where a stainless steel ball having a diameter of 10 mm attached to the device is used as a contact ball, a measuring weight is set to 200 g, and a measuring time is set to 1.6 mm/sec.

<Radius of Curvature R of Punch Shoulder>

5 mm

<Punch Temperature>

Room Temperature

<Dice Temperature>

200° C., 250° C.

<Blank Holder Temperature>

200° C., 250° C.

<Drawing Speed>

1 mm/sec

<Lubricating Oil and Lubricant>

Neither lubricating oil nor lubricant is used at the time of forming the magnesium alloy material of the present invention.

TABLE 1

| | water-soluble resin | | silane coupling agent | | colloidal silica | lubricant | | Metal alkoxide | | heat resistance imparting agent | | film |
|---|---|---|---|---|---|---|---|---|---|---|---|---|
| sample number | kind | Content (weight %) | kind | Content (weight %) | Content (weight %) | kind | Content (weight %) | kind | Content (weight %) | kind | Content (weight %) | thickness (μm) |
| 1 | URE | 85.0 | — | — | — | PTFE | 15 | — | — | — | — | 45 |
| 2 | URE | 69.5 | KMB903 | 0.5 | 30 | — | — | — | — | — | — | 2 |
| 3 | URE | 26.0 | KMB903 | 1.0 | 50 | PTFE | 8 | — | — | DMSX | 15 | 6 |
| 4 | AC-PES | 59.0 | KMB403 | 1.0 | 15 | PTFE | 15 | — | — | DMSX | 10 | 5 |
| 5 | PES | 55.0 | — | — | 25 | — | — | — | — | MPSX | 20 | 8 |
| 6 | PES | 55.5 | KMB403 | 4.5 | 40 | — | — | — | — | — | — | 4 |
| 7 | ACR | 85.0 | KMB903 | 1.0 | — | PTFE | 14 | — | — | — | — | 0.4 |
| 8 | ACR | 34.5 | KMB903 | 0.5 | 35 | — | — | — | — | MPSX | 30 | 5 |
| 9 | ACR | 47.0 | — | — | 48 | — | — | — | — | MPSX | 5 | 8 |
| 10 | FE-ACR | 76.5 | KMB403 | 0.5 | 20 | — | — | TIET | 3.0 | — | — | 3 |
| 11 | EPO | 21.0 | KMB403 | 1.0 | — | — | — | — | — | DMSX | 78 | 30.5 |
| 12 | EPO | 40.0 | — | — | 20 | PTFE | 10 | — | — | DMSX | 30 | 4.5 |
| 13 | URE + EPO | 80.0 | — | — | — | PTFE | 5 | — | — | MPSX | 15 | 3 |
| 17 | — | — | — | — | — | — | — | — | — | — | — | — |
| 18 | — | — | — | — | — | — | — | — | — | — | — | F resin 50 μm |

URE: urethane,
PES: polyester,
ACR: acrylic,
EPO: epoxy,
AC-PES: acryl-modified polyester,
FE-ACR: phenyl silicon modified acrylic,
KBM903: amino-based silane coupling agent made by Shin-Etsu Chemical Co., Ltd.,
KBM403: epoxy-based silane coupling agent made by Shin-Etsu Chemical Co., Ltd.,
TIET: titanium ethoxide,
PTFE: polytetrafluoroethylene,
DMSX: dimethylsiloxane,
MPSX: methylphenylsiloxane,
F resin: applying fluororesin film having a thickness of 50 μm to upper and lower surfaces of magnesium alloy sheet at the time of drawing As comparison examples, comparison-use magnesium alloy press-formed bodies are prepared in the following manner. That is, a sample indicated by a sample number 17 is prepared by applying a commercially lubricating oil G3080 (made by NIHON KOHSAKUYU CO., LTD.) to both surfaces of the above-mentioned magnesium alloy material, and a sample indicated by a sample number 18 is prepared by mounting a fluororesin film having a thickness of 50 μm on both surfaces of the magnesium alloy material. Drawing is applied to these samples indicated by sample numbers 17, 18 under the substantially same conditions thus preparing the comparison-use magnesium alloy press-formed bodies.

(Removal of Organic Resin Film)

From the magnesium alloy press-formed body of the present invention acquired in the above-mentioned manner, the organic resin film adhered to the magnesium alloy press-formed body as a remaining material is removed under following conditions.

<Removal Bath>

Bath Composition

Aqueous solution produced by mixing 300 mL/L of TOP MAGSTER 100 (made by Okuno Chemical Industries Co., Ltd.) and 10 mL/L of TOP MAGSTER 100AD (made by Okuno Chemical Industries Co., Ltd.)

pH: 13.4

Bath temperature 70° C.

Agitation: supersonic waves

Immersing time: 10 minutes

Samples indicated by sample numbers 1 to 13 are prepared.

(Surface Treatment)

Anodizing is applied to the sample indicated by the sample number 3 under following conditions as the surface treatment thus preparing a sample indicated by a sample number 14.

<Anodizing>

Bath composition

Ammonium dichromate: 40 g/L

Ammonium sulfate: 25 g/L

Aqueous ammonia: 3.0 mL/L

Bath temperature: 40° C.

Agitation: bath circulation

Current density: 1 A/dm$^2$ (Coating)

A transparent polyether resin coating material is applied to the sample indicated by the sample number 3 and is dried such that a thickness of the coating material after drying becomes 10 μm thus preparing a sample indicated by a sample number 15.

(Surface Treatment and Coating)

Anodizing is applied to the sample indicated by the sample number 3 in the same manner as the sample indicated by the sample number 14 and, thereafter, coating is applied to the sample indicated by the sample number 3 in the same manner as the sample indicated by a sample number 15 thus preparing a sample indicated by a sample number 16.

(Comparison Sample)

By removing the lubricating oil adhered to the surface of the magnesium alloy press-formed body of the comparison example with acetone, a sample indicated by a sample number 17 is prepared. Further, by removing a fluororesin film of the magnesium alloy press-formed body of the comparison example, a sample indicated by the sample number 18 is prepared.

(Evaluation of Surface Appearance of Magnesium Alloy Press-Formed Body)

Appearances of magnesium alloy press-formed bodies indicated by sample numbers 1 to 18 obtained in the above-mentioned manner are observed with naked eyes and are evaluated with following criteria.

Excellent: no damage recognized on surface of sample

Good: no degrading damage in practical use recognized

Fair: degrading damage in practical use recognized (Evaluation of Post-Treatment Property)

With respect to the magnesium alloy press-formed bodies indicated by the sample numbers 14 to 16, after removing the organic resin film adhered as the remaining material, the post treatment (anodizing and/or coating) is applied, and a post-treatment state is observed with naked eyes and is evaluated under following criterion.

Good: no degrading appearance in practical use recognized

Results of these evaluations are shown in Table 2.

TABLE 2

| sample number | working temperature and sample temperature at the time of measuring friction coefficient (° C.) | friction coefficient | use of lubricating oil or lubricant | draw ratio | post-formability | surface appearance | distinction |
|---|---|---|---|---|---|---|---|
| 1 | 200 | 0.16 | not used | 2.6 | — | good | present invention |
| 2 | 200 | 0.17 | not used | 2.4 | — | good | present invention |
| 3 | 250 | 0.13 | not used | 3.8 | — | excellent | present invention |
| 4 | 250 | 0.13 | not used | 4.0 | — | excellent | present invention |
| 5 | 250 | 0.14 | not used | 3.5 | — | excellent | present invention |
| 6 | 200 | 0.18 | not used | 3.2 | — | good | present invention |
| 7 | 200 | 0.14 | not used | 2.6 | — | good | present invention |
| 8 | 250 | 0.15 | not used | 3.5 | — | excellent | present invention |
| 9 | 250 | 0.12 | not used | 3.5 | — | excellent | present invention |
| 10 | 250 | 0.15 | not used | 2.8 | — | good | present invention |
| 11 | 250 | 0.14 | not used | 3.1 | — | excellent | present |

TABLE 2-continued

| sample number | working temperature and sample temperature at the time of measuring friction coefficient (° C.) | friction coefficient | use of lubricating oil or lubricant | draw ratio | post-formability | surface appearance | distinction |
|---|---|---|---|---|---|---|---|
| | | | | | | | invention |
| 12 | 250 | 0.12 | not used | 3.0 | — | excellent | present invention |
| 13 | 200 | 0.14 | not used | 2.4 | — | excellent | present invention |
| 14 | 250 | 0.13 | not used | 3.8 | good | excellent | present invention |
| 15 | 250 | 0.13 | not used | 3.8 | good | excellent | present invention |
| 16 | 250 | 0.13 | not used | 3.8 | good | excellent | present invention |
| 17 | 250 | 0.28 | lubricating oil used | 1.8 | — | fair | comparison example |
| 18 | 250 | 0.20 | fluororesin film used | 3.4 | — | excellent | comparison example |

As shown in Table 2, the magnesium alloy press-formed bodies of the present invention can be obtained by applying the organic resin to the magnesium alloy material by coating, applying the press-forming to the resin-coated magnesium alloy material and, thereafter, by removing the organic resin adhered to the magnesium alloy material as the remaining material using the organic resin removing liquid. Accordingly, the magnesium alloy press-formed bodies of the present invention can be press-formed with high formability. Further, compared to the magnesium alloy press-formed body which is press-formed using the lubricating oil conventionally, almost no abrasions are generated on the surface of the magnesium alloy press-formed body and hence, the magnesium alloy press-formed body of the present invention can obtain the surface state as beautiful as the surface state of the magnesium alloy press-formed body using an expensive fluororesin film. Further, after removing the organic resin film adhered to the magnesium alloy press-formed body of the present invention as the remaining material, it is possible to apply the post treatment such as the surface treatment including the anodizing and/or coating for enhancing corrosion resistance and the appearance without any problems.

Industrial Applicability

The present invention is characterized by press-forming the magnesium alloy material into a predetermined shape by applying the organic resin for imparting formability to the surface of the magnesium alloy material by coating and, thereafter, by removing the organic resin using the resin removing liquid. The magnesium alloy press-formed body obtained by press-forming using the manufacturing method of the magnesium alloy press-formed body of the present invention enables press-forming with high formability. Further, compared to the magnesium alloy press-formed body obtained by press-forming using the conventional lubricant, abrasions are hardly generated on the surface of the magnesium alloy press-formed body and hence, the magnesium alloy press-formed body of the present invention possesses the surface substantially as beautiful as the surface of the magnesium alloy press-formed body obtained by press-forming using the expensive fluororesin film. Further, the organic resin can be easily removed using the inexpensive removing liquid. Accordingly, in manufacturing the magnesium alloy press-formed body using the manufacturing method of the present invention, the obtained magnesium alloy press-formed body possesses the beautiful surface free from abrasions, and can be manufactured at a low cost. The magnesium alloy press-formed body of the present invention is preferably applicable to a material for members of an exterior casing of a miniaturized portable electronic equipment such as a mobile communication equipment or a notebook-type personal computer, a material for members of a large-sized casing such as a traveling suitcase or a document accommodating attaché case, a material for automobile-use members such as a hood, a trunk lid, doors or fenders and the like.

The invention claimed is:

1. A manufacturing method of a magnesium alloy press-formed body, comprising:

coating an organic resin capable of imparting formability onto a surface of a magnesium alloy material;

press-forming the organic resin-coated magnesium alloy material at a temperature of 200-350 ° C. into a desired shape under conditions whereby the magnesium alloy material subjected to said press-forming exhibits a friction coefficient of 0.2 or less at said press-forming temperature, and removing the organic resin from the organic resin-coated magnesium alloy materialby immersing in a resin removing liquid which includes an alkaline aqueous solution having pH of 10 or more;

wherein the organic resin comprises one, two or more resins selected from the group consisting of a water-soluble urethane resin, a water-soluble polyester resin, a water-soluble acrylic resin, a water-soluble epoxy resin, and a resin produced by modification of any one of said organic resins.

2. A manufacturing method of a magnesium alloy press-formed body according to claim 1, wherein after removing the organic resin, surface treatment and/or coating is applied to the magnesium alloy material press-formed in the desired shape.

3. A manufacturing method of a magnesium alloy press-formed body according to claim 1, wherein the organic resin further comprises one, two or more selected from the group consisting of a silane coupling agent, colloidal silica, a lubricant, and a metal alkoxide.

4. A manufacturing method of a magnesium alloy press-formed body according to claim 3, wherein as the organic resin, an organic resin containing a heat resistance imparting agent is further used.

* * * * *